US005724680A

United States Patent [19]

Cesnick et al.

[11] Patent Number: 5,724,680

[45] Date of Patent: Mar. 10, 1998

[54] LINER FOR RUBBER BOOTS

[76] Inventors: Andrew J. Cesnick; Michael W. Cesnick, both of 71 Spruce St., Natrona, Pa. 15065

[21] Appl. No.: 774,250

[22] Filed: Nov. 12, 1996

[51] Int. Cl.[6] ..... A41B 11/00

[52] U.S. Cl. ..... 2/239; 36/4

[58] Field of Search ..... 2/239, 240, 242; 36/87, 7.4, 7.3, 8.1, 4, 9 A, 34 A, DIG. 2

[56] References Cited

U.S. PATENT DOCUMENTS

| | | | |
|---|---|---|---|
| 1,074,595 | 10/1913 | Aumont | 2/239 |
| 2,582,648 | 1/1952 | Mowbray | 2/239 |
| 2,666,207 | 1/1954 | Lucas | 2/239 |
| 2,741,770 | 4/1956 | Tannen | 2/239 |
| 3,747,125 | 7/1973 | Goldman et al. | 2/240 |
| 5,325,541 | 7/1994 | Willard | 2/239 |
| 5,430,896 | 7/1995 | Bisley | 2/239 |

FOREIGN PATENT DOCUMENTS

| | | | |
|---|---|---|---|
| 101227 | 6/1937 | Australia | 2/239 |
| 182086 | 5/1955 | Germany | 2/239 |
| 518059 | 2/1940 | United Kingdom | 2/239 |

*Primary Examiner*—Gloria Hale

[57] ABSTRACT

A liner for rubber boots that includes an inner sock. The inner sock has an over sized foot shape for loosely enclosing a wearer's foot. The sock has an upper portion with a pair of slots and a sole portion. At least two elongated strips of non-slip fabric wherein each strip has an adhesive on one side to allow the strips to be attached to the sole of the sock. Lastly, at least one elongated strap having a first end positionable through the slot of the inner sock and a second end that is capable of being coupled to the first end to form a support loop.

8 Claims, 3 Drawing Sheets

LINER FOR RUBBER BOOTS

BACKGROUND OF THE INVENTION

1. Field of the Invention

The present invention relates to a liner for rubber boots and more particularly pertains to providing an accessory for rubber boots, hip boots or wading boots, that will provide additional foot protection and extend the useful life of the rubber boots.

2. Description of the Prior Art

The use of a sock is known in the prior art. More specifically, socks heretofore devised and utilized for the purpose of enclosing a foot are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,359,731 to Cavalier discloses a protective garment. U.S. Pat. No. 5,339,545 to Paris discloses a ski boot liner. U.S. Pat. No. 5,325,541 to Willard discloses a waterproof oversock. U.S. Pat. No. 5,067,260 to Jenkins, Jr. discloses an overboot waders. U.S. Pat. No. 4,984,377 to Schneider discloses an all conditioning fishing waders. Lastly, U.S. Pat. No. Des. 273,624 to Finch discloses a wade fishing boot.

While these devices fulfill their respective, particular objectives and requirements, the aforementioned patents do not describe liner for rubber boots that allows an inner sock formed of a rubberized material to function as a liner for rubber boots, with the liner supported in an upright position by a strap and prevented from slipping or moving within the boot by the application of a non-slip strip, to extend the life of the rubber boot.

In this respect, the liner for rubber boots according to the present invention substantially departs from the conventional concepts and designs of the prior art, and in doing so provides an apparatus primarily developed for the purpose of providing an accessory for rubber boots, hip boots or wading boots, that will provide additional foot protection and extend the useful life of the rubber boots.

Therefore, it can be appreciated that there exists a continuing need for a new and improved liner for rubber boots which can be used for providing an accessory for rubber boots, hip boots or wading boots, that will provide additional foot protection and extend the useful life of the rubber boots. In this regard, the present invention substantially fulfills this need.

SUMMARY OF THE INVENTION

In view of the foregoing disadvantages inherent in the known types of socks now present in the prior art, the present invention provides an improved liner for rubber boots. As such, the general purpose of the present invention, which will be described subsequently in greater detail, is to provide a new and improved liner for rubber boots and method which has all the advantages of the prior art and none of the disadvantages.

To attain this, the present invention essentially comprises an inner sock of waterproof material. The inner sock has an oversized foot shape for loosely enclosing a wearer's foot. The sock has an upper portion with a semi-rigid interior member and an upper edge that defines an opening. The sock has a sole portion. The upper portion has a pair of horizontal slots. Each one of the horizontal slots is in symmetrical alignment with another of the horizontal slots. Also, at least two elongated strips of non-slip fabric are provided. The strips are composed of waterproof material and have an adhesive on one side. The adhesive of the two strips allow the strips to be attached to the sole of the sock. The two strips are attached to the sole of the inner sock in a parallel orientation that is relative to the sole and in a substantially spaced and parallel orientation relative to one another. The two strips, are attached to the inner sock prior to wearer positioning the inner sock within a rubber boot, disallow movement of the inner sock within the rubber boot. Lastly, at least one elongated strap is provided. The strap has a first end and second end. The first end has a fastening means that is attached and the second end has a receiving means for coupling with the fastening means of the first end. The first end of the strap is passed through at least one of the horizontal slots of the inner sock and around a belt of the sock wearer, and coupling with the second end to form a support loop. The support loop supports the inner sock around the wearer's foot when the foot is positioned within the rubber boot.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved liner for rubber boots which has all of the advantages of the prior art socks and none of the disadvantages.

It is another object of the present invention to provide a new and improved liner for rubber boots which may be easily and efficiently manufactured and marketed.

It is further object of the present invention to provide a new and improved liner for rubber boots which is of durable and reliable constructions.

An even further object of the present invention is to provide a new and improved liner for rubber boots which is susceptible of a low cost of manufacture with regard to both materials and labor, and which accordingly is then susceptible of low prices of sale to the consuming public, thereby making such liner for rubber boots economically available to the buying public.

Even still another object of the present invention is to provide a liner for rubber boots for providing an accessory for rubber boots, hip boots or wading boots, that will provide additional foot protection and extend the useful life of the rubber boots.

Lastly, it is an object of the present invention to provide a new and improved liner for rubber boots that includes an inner sock that has an over sized foot shape for loosely enclosing a wearer's foot. The sock has an upper portion with a pair of slots and a sole portion. At least two elongated strips of non-slip fabric have an adhesive on one side to allow the strips to be attached to the sole of the sock. Lastly, at least one elongated strap having a first end positionable through the slot of the inner sock and a second end that is capable of being coupled to the first end to form a support loop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
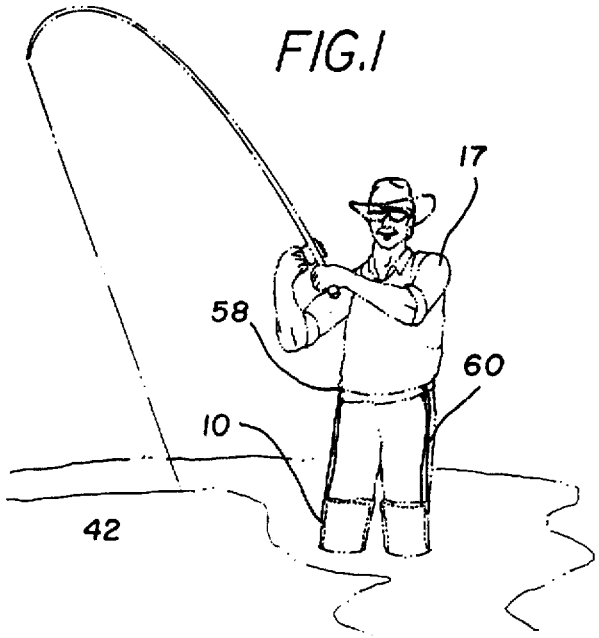
FIG. 1 is a perspective view of the preferred embodiment of the liner for rubber boots in an operable orientation when used by a wearer.

With reference now to the drawings, and in particular to FIGS. 1–6 thereof, the preferred embodiment of the new and improved liner for rubber boots embodying the principles and concepts of the present invention and generally designated by the reference numeral 10 will be described.

The present invention, the liner for rubber boots 10 is comprised of a plurality of components. Such components in their broadest context include an inner sock, an elongated strip and a strap. Such components are individually configured and correlated with respect to each other so as to attain the desired objective.

Figure 2:
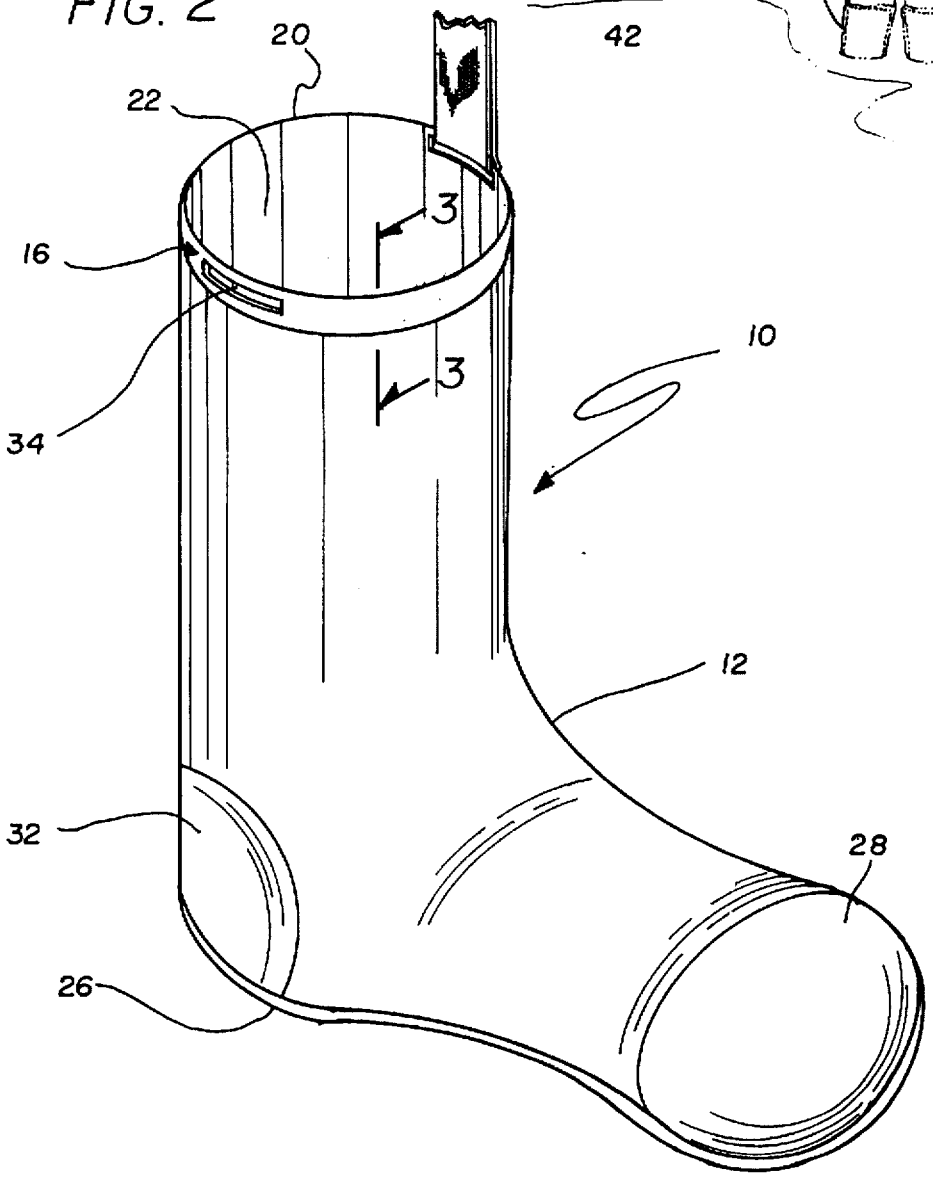
FIG. 2 is an isometric view of the preferred embodiment of the present invention.
Figure 3:
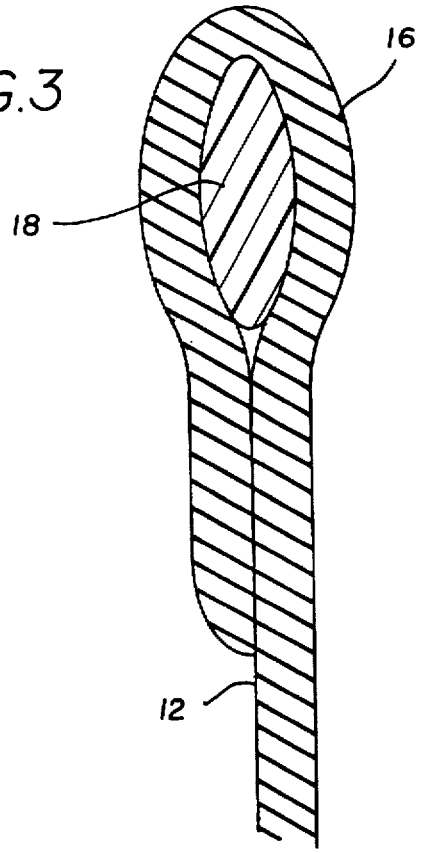
FIG. 3 is a cross-sectional view of the upper portion of the present invention taken along line 3—3 of FIG. 2.
Figure 4:
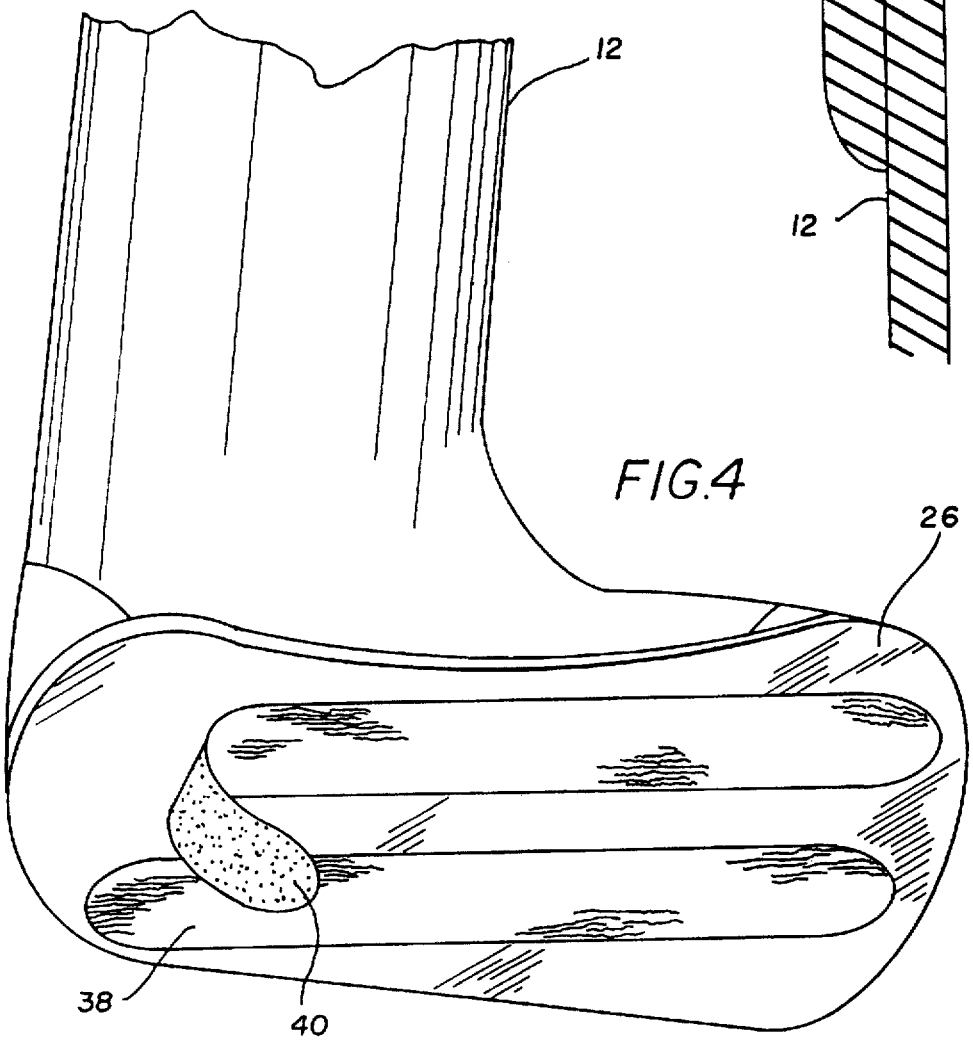
FIG. 4 is a bottom plan view of the present invention showing the strips.

Specifically, the present invention includes an inner sock 12 of waterproof material. Preferably, the inner sock is made of a synthetic rubber having a thickness of about 1/32 of inch. The inner sock has an oversized foot shape for loosely enclosing a wearer's foot 17. The sock has an upper portion 16 with a semi-rigid member 18 and an upper edge 20 that defines an opening 22. The opening of the inner sock will allow the wearer's foot to be placed within the inner sock. The interior member reinforces the upper portion and the upper edge of the inner sock and prevents ripping and tearing. As seen in FIG. 2, the sock has a sole portion 26. The inner sock has a reinforced toe portion 28 and a reinforced heel portion 32. These portions of the inner sock have a thickness of about 1/16 of an inch. The toe and heel portions are thicker to withstand the greater amount of wear that normally occurs to these areas of the inner sock of the liner.

As best illustrated in FIG. 1, the upper portion has a pair of horizontal slots 34. Each one of the horizontal slots is in symmetrical alignment with another of the horizontal slots. Each slot passes through the interior member of the upper portion. Passing each slot through the interior member will not reduce the strength and integrity of the interior member.

Also, at least two elongated strips 38 of non-slip fabric are provided. Each strips is composed of waterproof material and has an adhesive 40 on one side. The adhesive of the two strips allows each strip to be attached to the sole 26 of the inner sock. The two strips are attached to the sole of the inner sock, as shown in FIG. 2, in a parallel orientation relative to the sole, and in a substantially spaced and parallel orientation relative to one another. The two strips extend horizontally from near the toe portion to near the heel portion when positioned on the inner sole. The two strips are attached to the inner sock prior to wearer positioning the inner sock within a rubber boot. The strips will disallow movement of the inner sock within the rubber boot when the foot, with the sock, is positioned in the rubber boot.

Figure 5:
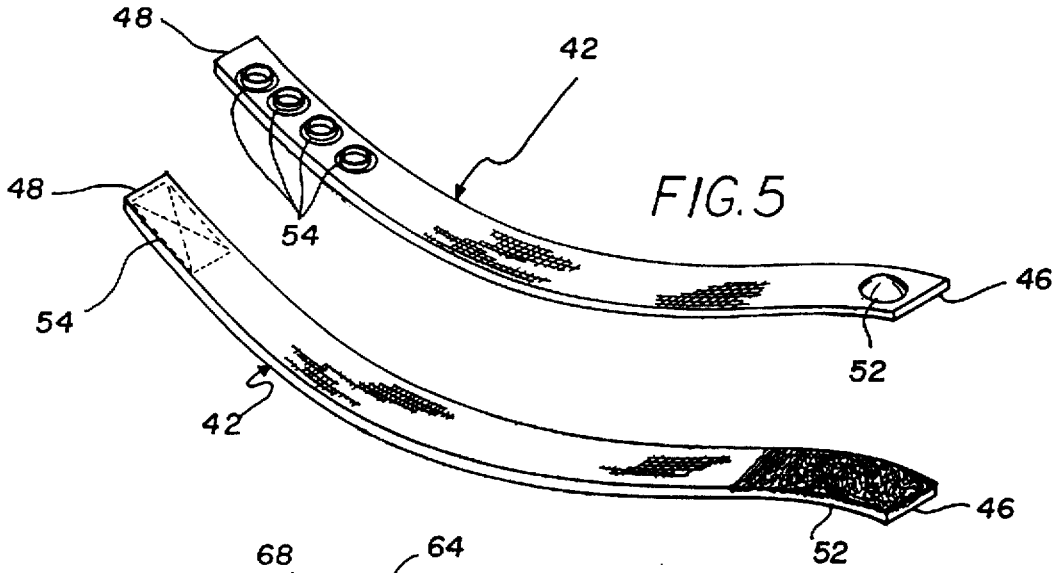
FIG. 5 is an isometric view of two forms of the strap of the present invention used in FIG. 2.

Lastly, at least one elongated strap 42 is included. The strap has a first end 46 and second end 48. The first end has a fastening means 52 attached and the second end has a receiving means 54 for coupling with the fastening means of the first end. FIG. 5 shows two different fastening systems, both including a fastening means and receiving means, for the strap. In one instance, the fastening means is a female portion of a snap-type fastener and the receiving means is a male portion of a snap-type fastener. In another instance, the fastening means is a pile-type component and the receiving means is a recipient pile-type component. Either fastener system will work in the present invention.

In use, the first end of the strap is passed through at least one of the horizontal slots 34 of the inner sock 12 and around a belt 58 of the sock wearer, and couples with the second end to form a support loop 60. The support loop supports the inner sock, in an upright position, around the wearer's foot when the foot is positioned within the rubber boot.

Figure 6:
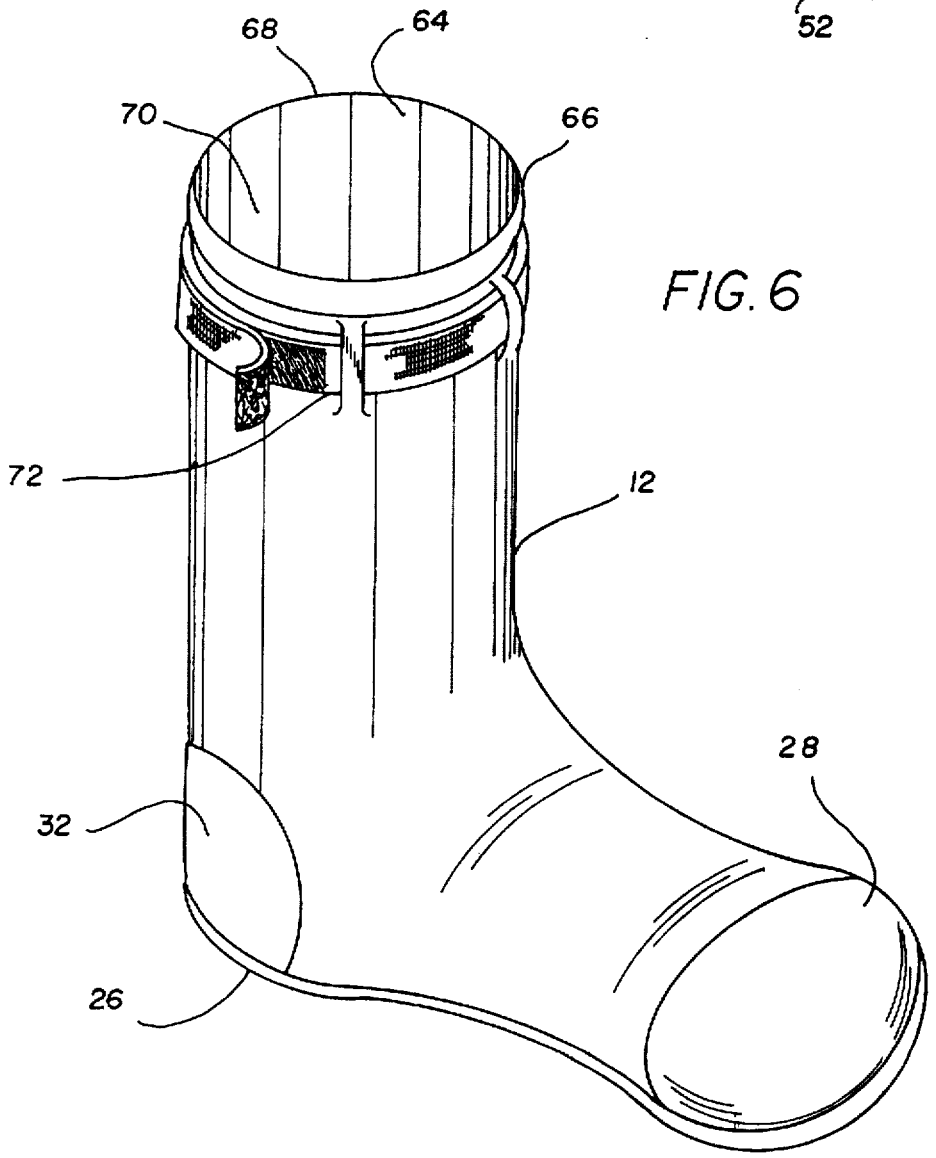
FIG. 6 is an isometric view of an alternative embodiment of the present invention of FIG. 1.

Furthermore, as shown in FIG. 6, the inner sock may have an alternative embodiment near the upper portion. In the alternative embodiment 64, the inner sock is made of waterproof material and has an oversized foot shape for loosely enclosing a wearer's foot. The inner sock 64 has an upper portion 66 with an upper edge 68 that defines an opening 70. The sock has a sole portion 26 identical to the sole portion in inner sock 12. The inner sock has a plurality of vertical slits 72 that are through the inner sock and adjacent the upper portion. The plurality of vertical slits are proportionately spaced about the inner sock near the upper portion in slit pairs. Each slit of the slit pair of the plurality of vertical slits is in a parallel orientation relative to another slit of the slit pair. All of the components of the inner sock 64 are identical to the inner sock 12. One exception is the placement of the one elongated strap. In the alternative embodiment, the first end of the strap and the second end of the strap are passed through the plurality of slits adjacent the upper portion of the inner sock. The first end and the second end, when positioned within the slits and around the inner sock are coupled to form a support loop. The support loop supports the inner sock around the wearer's foot when positioned within the rubber boot.

The present invention liner for rubber boots is an accessory for any person that wears rubber boots. This invention may be used with hipboot or wading boots. Preferably, the liner, when used with hip boots, will have the horizontal slots and use the straps to hold the liner in an upright orientation by looping the strap through the horizontal slots and around the wearer's belt. When the wearer uses wading boots, the present invention has an alternative embodiment which includes vertical slots. When using the liner for wading boots, the straps are threaded through the vertical slots and fastened together to hold the liner in an upright orientation within the rubber boots.

A synthetic rubber material is used to make the liner. The material is fairly thick and nearly 1/32 of an inch throughout. Areas of the sock that has a varying thickness are the toe and heel portions of the sock of the liner. These areas of the sock may have a greater thickness. The liners add durability, warmth, and increase the useful life of rubber boots. The liners increase the useful life of the rubber boots by providing a second layer of protection in case the rubber boots get a hole or a rip in them. Attached to the bottom sock of the liner is a pair of non-slip strips. These strips help to keep the liner from slipping inside the rubber boots and ensuring that it has a comfortable fit around the foot. The liner for rubber boots are sold in pairs like shoes and socks. The wearer, when using the liner with rubber boots, will be able to keep their feet and legs dry and warm even when the boot gets a hole in them. The extra layer of protection inside the boots will keep the feet warm whether using the boots at work or at play.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A liner for rubber boots to provide a second layer of foot protection comprising in combination:

an inner sock of water proof material having an over sized foot shape for loosely enclosing a wearer's foot, the sock having an upper portion with a semi-rigid interior member and an upper edge defining an opening therein, the sock having a sole portion, the upper portion having a pair of horizontal slots therethrough, each one of the horizontal slots being in symmetrical alignment with another of the horizontal slots;

at least two elongated strips of non-slip fabric being composed of waterproof material and having an adhesive on one side thereof, the adhesive of the two strips allowing the strips to be attached to the sole of the sock, the two strips being attached to the sole of the inner sock in a parallel orientation relative to the sole and in a substantially spaced and parallel orientation relative to one another, the two strips being attached to the inner sock prior to the wearer positioning the inner sock within a rubber boot for disallowing movement of the inner sock within the rubber boot; and at least one elongated strap having a first end and a second end, the first end having a fastening means attached thereto and the second end having a receiving means for coupling with the fastening means of the first end, the first end of the strap being passed through at least one of the horizontal slots of the inner sock and around a belt of the sock wearer and coupling with the second end forming a support loop, the support loop supporting the inner sock around the wearer's foot when positioned within the rubber boot.

2. A liner for rubber boots comprising:

an inner sock having an over sized foot shape for loosely enclosing a wearers foot, the sock having an upper portion with a pair of slots and a sole portion,;

at least two elongated strips of non-slip fabric having an adhesive on one side for allowing the strips to be attached to the sole of the sock; and at least one elongated strap having a first end positionable through the slot of the inner sock and a second end capable of being coupled to the first end to form a support loop.

3. The liner for rubber boots as set forth in claim 2, wherein the upper portion of the inner sock has a semi-rigid interior member and an upper edge defined by an opening therein.

4. The liner for rubber boots as set forth in claim 3, wherein the pair of slots are horizontal and pass through the interior member of the upper portion, and each one of the horizontal slots are in symmetrical alignment with another of the horizontal slots.

5. The liner for rubber boots as set forth in claim 2, wherein the two elongated strips are composed of waterproof material, the two elongated strips are attached to the sole portion of the inner sock in a parallel orientation relative to the sole portion and in a substantially spaced and parallel orientation relative to one another, and the two strips are attached to the inner sock prior to the wearer positioning the inner sock within a rubber boot for disallowing movement of the inner sock within the rubber boot.

6. The liner for rubber boots as set forth in claim 2, wherein the first end of the elongated strap has a fastening means attached thereto and the second end of the elongated strap has a receiving means for coupling with the fastening means of the first end.

7. The liner for rubber boots as set forth in claim 6, wherein the first end of the strap when passed through at least one of the slots of the inner sock is placed around a belt of the sock wearer prior to coupling with the second end to form the support loop, and the support loop supporting the inner sock around the wearers foot when positioned within the rubber boot.

8. A liner for rubber boots to provide a second layer of foot protection comprising in combination:

an inner sock of water proof material having an over sized foot shape for loosely enclosing a wearer's foot, the sock having an upper portion with an upper edge defining an opening therein, the sock having a sole portion, the inner sock having a plurality of vertical slits therethrough and adjacent the upper portion, the plurality of vertical slits being proportionately spaced about the inner sock near the upper portion in slit pairs, each slit of the slit pair of the plurality of vertical slits being in a parallel orientation relative to another slit of the slit pair;

at least two elongated strips of non-slip fabric being composed of waterproof material and having an adhesive on one side thereof, the adhesive of the two strips allowing the strips to be attached to the sole portion of the sock, the two strips being attached to the sole portion of the inner sock in a parallel orientation relative to the sole portion and in a substantially spaced and parallel orientation relative to one another, the two strips being attached to the inner sock prior to the wearer positioning the inner sock within a rubber boot for disallowing movement of the inner sock within the rubber boot; and at least one elongated strap having a first end and a second end, the first end having a fastening means attached thereto and the second end having a receiving means for coupling with the fastening means of the first end, the first end of the strap and the second end of the strap being passed through the plurality of slits adjacent the upper portion of the inner sock, the first end and the second end, when positioned within the slits and around the inner sock, being coupled thereto forming a support loop, the support loop supporting the inner sock around the wearer's foot when positioned within the rubber boot.

* * * * *